US011085274B2

(12) United States Patent
Pavlov et al.

(10) Patent No.: US 11,085,274 B2
(45) Date of Patent: Aug. 10, 2021

(54) METHOD AND SYSTEM FOR THE OPTIMISATION OF THE ADDITION OF DILUENT TO AN OIL WELL COMPRISING A DOWNHOLE PUMP

(71) Applicant: STATOIL PETROLEUM AS, Stavanger (NO)

(72) Inventors: Alexey Pavlov, Porsgrunn (NO); Kjetil Fjalestad, Skien (NO)

(73) Assignee: STATOIL PETROLEUM AS, Stavanger (NO)

( * ) Notice: Subject to any disclaimer, the term of this patent is extended or adjusted under 35 U.S.C. 154(b) by 148 days.

(21) Appl. No.: 15/769,997

(22) PCT Filed: Oct. 22, 2015

(86) PCT No.: PCT/NO2015/000027
§ 371 (c)(1),
(2) Date: Apr. 20, 2018

(87) PCT Pub. No.: WO2017/069633
PCT Pub. Date: Apr. 27, 2017

(65) Prior Publication Data

US 2019/0063193 A1 Feb. 28, 2019

(51) Int. Cl.
*E21B 41/00* (2006.01)
*E21B 43/12* (2006.01)
(Continued)

(52) U.S. Cl.
CPC ..... *E21B 41/0092* (2013.01); *E21B 43/121* (2013.01); *E21B 43/128* (2013.01); *E21B 43/25* (2013.01); *E21B 47/00* (2013.01)

(58) Field of Classification Search
CPC ..... E21B 43/121; E21B 43/128; E21B 43/25; E21B 47/00; E21B 44/00; E21B 41/0092
See application file for complete search history.

(56) References Cited

U.S. PATENT DOCUMENTS 6,535,795 B1 3/2003 Schroeder et al.
2005/0166961 A1* 8/2005 Means ..... E21B 37/06 137/13
(Continued)

FOREIGN PATENT DOCUMENTS

CA 2 592 880 A1 12/2008
CN 101684727 A 3/2010
(Continued)

OTHER PUBLICATIONS

International Search Report (PCT/ISA/210) issued in PCT/NO2015/000027, dated May 17, 2016.
(Continued)

*Primary Examiner* — Christopher J Sebesta
(74) *Attorney, Agent, or Firm* — Birch, Stewart, Kolasch & Birch, LLP

(57) ABSTRACT

A system for optimising injection of a diluent to one, some or all of one or more wells comprising a downhole pump and holding means for the diluent, said holding means being connected to the or each well via one or more injection lines through which the diluent may be pumped by diluent injection means, characterised in that said system comprises measurement means for real time measurement of one or more production performance parameters, and measurement of the rate of injection of the diluent; and means for optimising the injection of the diluent to at least one of said one or more wells on the basis of: (i) means for making controlled variations of the diluent injection into the at least or each well; (ii) means for the processing of the real time measurements of the production performance parameters affected by these variations to determine any necessary adjustment of the injection of the diluent towards an optimal value; and (iii) if required, making the corresponding physical adjustment of the injection of the diluent in order to bring
(Continued)

production performance closer to the optimal point, as well as a method for said optimisation.

24 Claims, 4 Drawing Sheets

(51) Int. Cl.
*E21B 43/25* (2006.01)
*E21B 47/00* (2012.01)

(56) References Cited

U.S. PATENT DOCUMENTS

2005/0173114 A1 8/2005 Cudmore et al.
2010/0200224 A1* 8/2010 Toguem Nguete ... E21B 43/121 166/250.15
2011/0264373 A1 10/2011 Hehmeyer et al.
2013/0312958 A1* 11/2013 Denyer ..... E21B 43/16 166/270
2014/0006111 A1* 1/2014 Priyesh ..... G06Q 10/0637 705/7.36
2014/0083688 A1* 3/2014 Rojas ..... E21B 44/00 166/250.01
2015/0233530 A1 8/2015 Sandidge
2016/0115395 A1* 4/2016 Rustad ..... C10G 33/08 700/282

FOREIGN PATENT DOCUMENTS

RU 2366804 C2 9/2009
WO WO 2008/150811 A1 12/2008

OTHER PUBLICATIONS

Written Opinion (PCT/ISA/237) issued in PCT/NO2015/000027, dated May 17, 2016.

* cited by examiner

METHOD AND SYSTEM FOR THE OPTIMISATION OF THE ADDITION OF DILUENT TO AN OIL WELL COMPRISING A DOWNHOLE PUMP

FIELD OF THE INVENTION

The invention relates to a system for optimising production from one or more wells and a method for optimising the rate of injection of a viscosity reducing fluid such as a diluent into one or more wells.

BACKGROUND OF THE INVENTION

In oil wells with downhole pumps as means of artificial lift, the high viscosity of the produced fluid can significantly reduce the efficiency of the downhole pump and increase the frictional pressure drop in the well. This leads to reduced production rates and high power consumption. The injection of lighter oil as a diluent (e.g. light oil with a low viscosity) and/or other fluids (e.g. water) may be used to reduce the viscosity of the fluid produced and therefore improve overall production efficiency. An alternative to diluent injection for the reduction of fluid viscosity is to inject water instead of the diluent. This is known as water continuous production; water is injected to invert the flow regime from oil continuous to water continuous, thus significantly reducing the viscosity of the mixture. Other chemicals (e.g. emulsion breakers) can also be used to reduce viscosity of the produced fluid. Although in this description we will primarily focus on diluent optimisation, the same concepts are valid for other fluids such as water, emulsion breakers and other chemicals that can reduce the viscosity of the highly viscous fluids as well, i.e. the fluids injected into these highly viscous fluids are viscosity reducing fluids. A schematic of a typical well with a downhole pump and diluent injection system with injection upstream the pump according to the prior art is shown in FIG. 1.

To optimise production from wells with injection of viscosity reducing fluids, one needs to optimise the injection rate for these fluids. By doing so, it is possible to get, for example higher production rates or lower power consumption of the downhole pumps.

Optimal injection rates of the viscosity reducing fluids can be found through extensive offline simulations of production in typical wells. These simulations are based on theoretical models and models obtained from laboratory experiments.

As an alternative to this offline model-based method, the diluent can be optimised online during production phase, but still based on detailed well and pump models. For example in CN101684727 the diluent optimisation method disclosed is based on comprehensive well models, but there is no consideration of downhole pumps or any other means of artificial lift. A similar model-based approach to optimisation is disclosed in US2005173114A1, in which power optimisation in a well with comprising a downhole pump, but without diluent injection, is disclosed. Another advanced model-based solution for optimisation is disclosed in U.S. Pat. No. 6,535,795B1. It discloses a method for the optimisation of the rate of chemical addition to a process. The invention is based on using measurements, adaptive models and decision rules to find an optimal injection rate and to send that optimal rate to local controllers that physically adjust the chemical addition rate.

Model-based optimisation is a common approach in planning and optimising oil production, in particular, production with injection of viscosity reducing fluids. Model-based methods, either offline or online, rely on accurate models of the fluid (density, viscosity etc.), flow in pipes (frictional pressure drop) and on models of the downhole pump—how the fluid flow affects the pump performance, and how the pump affects the fluid downstream from the pump (e.g. it can create emulsions that significantly increase the frictional pressure drop downstream from the pump).

Optimisation based on offline model-based simulations according to the prior art has a number of drawbacks. Optimisation methods based on offline simulations are subject to discrepancies between the models used in the simulations and reality. This may result in non-optimal operation. In some cases optimal injection rate or ratio of the flow rate of the injected viscosity reducing fluid to the produced flow rate from the reservoir (e.g. diluent cut) is calculated for some average well conditions. For a particular well, the production with this injection rate will be in most cases non-optimal due to differences between the real production conditions in that well and the average conditions used in the optimisation calculations. For example, experimental data shows that optimal diluent cut (for wells with diluent injection) depends on water cut of the produced reservoir fluid and reservoir productivity.

For model-based methods that use adaptation of the model parameters to available measurements ("online optimisation methods"), discrepancy between the reality and the models is less. However, some models may still be incorrect. Moreover these methods require adjustment of a number of model parameters to fit the measurements data, which requires time, attention and availability of qualified personnel.

Drawbacks associated with model-based methods can be summarized in the following list:

- Inaccurate models: The overall well models rely on a large number of interconnected models and a number of assumptions. This includes, for example,
  - a model of the pump performance for multiphase flow with (viscous) fluids,
  - a model of effect of the pump on the flow (e.g. creation of emulsions),
  - a model and assumptions on temperature distribution along the well, where temperature measurements may be unavailable;
  - a model of inflow from the reservoir (since direct measurements of the flow rates are not always available);
  - a model of the frictional pressure drop in the pipe for multiphase flow with viscous fluid
  - data on water cut, which may not always be available or accurate; and
  - data on gas volume fraction at the pump intake, which is computed from different measurements and may be in accurate.
- Moreover, for certain physical effects no reliable physical models are available yet, for example:
  - the effect of pump speed on the inversion point;
  - differences in the fluid viscosity experienced by the pump and experienced by the pipe downstream from pump;
  - differences in flow regimes in the pipe and in the pump, when the flow can be water continuous in the pump and oil continuous in the pipe downstream from the pump and vice versa;
  - how fast does the gas present at pump intake gets dissolved in oil and diluent while passing through the pump;

flow inversion happening half way through a pump (relevant for multistage pumps like ESPs).

In addition to the fact that there are uncertainties that can be hard to model at all (e.g. the quality of diluent), mixing with the oil phase upstream from the pump depends on what phase (water or oil) will be mostly exposed to the diluent, which is hard to predict; and how the diluent (fluid) mixing will evolve through the pump (thus changing the pump performance).

Some of the models listed above are theoretical (and are often the least accurate), while some are obtained in laboratory experiments (these are more accurate). However, the test facilities for these laboratory experiments are also often far from reproducing true field conditions, again leading to inaccurate models when scaling the results from the experiments up to the full scale field conditions. For example, most test facilities for testing ESP pump stages (to determine their performance for viscous fluids and gas) use synthetic fluids that do not reproduce the behavior of the real oil mixed with water and/or gas. Moreover, such test facilities are usually limited to testing pumps with a small number of stages (e.g. 10-20), whereas in reality the number of stages can be 4-6 times larger. Therefore the effects of the pump on the fluid due to the number of pump stages cannot be captured in these experiments. Thus, certain physical effects happening in a full scale pump with a real fluid cannot be reproduced in these experiments and thus they are not captured in the models resulting from these experiments.

All the uncertainties and inaccuracies inherent to these model-based approaches will lead to non-optimal production that can be quite far from the actual optimum.

To make the models used in the existing methods more reliable, one needs to use additional measurements (like flow rate, water cut, gas/oil ratio, temperatures, viscosity, density, etc.) to tune the models. Quite often there is no available instrumentation for these measurements, or the measurements are available only from time to time (e.g. when the flow is routed to a test separator to determine flow rate, water cut and gas content, or when detailed laboratory tests on the fluid samples are conducted). Hence, it may be difficult to introduce any significant improvement in the degree of reliability of the models in this manner.

Another problem is that well conditions change during production. Consequently, models in model-based optimisation methods need to be constantly re-tuned or adjusted to the new conditions. Otherwise the accumulating inaccuracies in models will lead to non-optimal operation:

The model-based methods with the large number of rather complex models and, correspondingly, the large number of tuning parameters in all these models make it difficult to achieve fast and accurate tuning of the models to the new well conditions.

Using neural networks or model adaptation for automatic tuning of the models (like in U.S. Pat. No. 6,535,795B1) requires that the well undergoes sufficient variations in production conditions (e.g. through a well test). Otherwise, it may not be possible to identify and tune key parameters of the models (this is a known fact from identification theory). However, U.S. Pat. No. 6,535,795B1 lacks components that provide such variations for identification purposes.

Clearly, there is a need to provide an improved system and method for determining the optimal injection rate of viscosity reducing fluid into oil wells comprising downhole pumps to optimise production characteristics like production rate or power consumption by the pumps. There is also a need to continuously control the diluent injection rate to the optimal value.

SUMMARY OF THE INVENTION

The present inventors have found that it is possible to provide an improved system and method for determining the optimal injection rate for a viscosity reducing fluid into one or more oil wells comprising one or more downhole pumps, so as to optimise the reduction of viscosity of the production fluid thus produced from said one or more oil wells and thus optimise the production performance of said one or more wells through increase of efficiency of the downhole pumps and reduction of the frictional pressure drop in said one or more wells. The invention applies equally to both single and multiple wells equipped with downhole pumps and fluid injection systems. The system and method of the invention do not suffer from the problems associated with the model-based and theory-based systems of the prior art described above such as the changes of viscosity reducing fluid (e.g. diluent) efficiency in different well conditions, e.g. with varying water cuts; the inaccuracy of the models and the assumptions on which they are based; labor- and knowledge intensive tuning of the models to measurements data.

Thus, in a first aspect of the present invention there is a system for optimising the injection of a viscosity reducing fluid to one, some or all of one or more wells, comprising a downhole pump positioned in the or each well, and holding means for a viscosity reducing fluid, said holding means being connected to the or each well via one or more injection lines through which the viscosity reducing fluid may be pumped by viscosity reducing fluid injection means;

characterised in that said system comprises:

(a) measurement means for real time measurement of one or more production performance parameters of said one or more wells, and measurement of the rate of injection of the viscosity reducing fluid into said one or more wells; and (b) means for optimising the injection of the viscosity reducing fluid to at least one of said one or more wells so as to optimise the production performance on the basis of: (i) adjustment of the production process through controlled variations of the viscosity reducing fluid injection into said one well or more than one wells; (ii) means for the processing of the real time measurements of the production performance parameters affected by these variations to determine any necessary adjustment of the injection of the viscosity reducing fluid towards an optimal value; and (iii) if required, making the corresponding physical adjustment of the injection of the viscosity reducing fluid in order to bring production performance closer to the optimal point.

The term production performance in the description above corresponds to the production characteristics either measured or calculated/estimated from the measurements—that need to be optimised, e.g. minimized or maximized. The production performance parameters can correspond to any of: liquid flow rate produced by the well, oil flow rate produced by the well, gas flow rate produced by the well, pressure at the pump intake, pressure at the pump discharge, pressure at the well head, pressure at a location in the well, temperature at the pump intake, temperature at the pump discharge, temperature at the well head, temperature at a location in the well, power consumed by the pump; current supplied to the pump electrical motor; ratio of power consumed by the pump and the liquid flow rate produced by the well, ratio of power consumed by the pump and the oil flow rate produced by the pump, ratio of current supplied to the electrical motor of the pump and the liquid flow rate produced by the well, ratio of current supplied to the electrical motor of the pump and the oil flow rate produced by the well, ratio of the oil flow rate produced by the well and the rate of the viscosity reducing fluid injected in the well, the efficiency of the pump, and the efficiency of the overall production system, or to a combination of any two or more of these parameters.

The system of the present invention is highly advantageous compared to those of the prior art. Instead of using models (which can be inaccurate or unreliable or may require additional measurements) for calculating the optimal injection rate of a viscosity reducing fluid, the system of the present invention uses the well itself as a "calculator" to bring the injection rate for one well or distribution of viscosity reducing fluid rate between the wells to optimal values.

In a second aspect of the present invention, there is provided a method for optimising the injection of a viscosity reducing fluid into one or more wells, wherein the or each well comprises a downhole pump, and the viscosity reducing fluid is pumped via one or more injection lines by viscosity reducing fluid injection means to the or each well, the method comprising:

(a) optionally, stopping the injection of the viscosity reducing fluid into one or more wells and determining the change in the production performance of the or each well or more than one well, and then (i) maintaining the stoppage of the injection of the viscosity reducing fluid to each well where the production performance improves or remains the same, or (ii) resuming injection of the viscosity reducing fluid at the previous injection rate to each well where the production performance deteriorates;

(b) optionally, replacing a first viscosity reducing fluid with a second viscosity reducing fluid or water and then determining whether the production performance improves, in which case the second viscosity reducing fluid or water is retained, or whether it deteriorates in which case the second viscosity reducing fluid or water is replaced by the first viscosity reducing fluid;

(c) varying the rate of injection of the viscosity reducing fluid to the one or more wells, measuring or calculating from measurements the variation in the production performance in the one or more wells corresponding to the variation of the rate of injection of the viscosity reducing fluid and calculating the gradient of the production performance for the one or more wells as a function of the rate of injection of viscosity reducing fluid the one or more wells; and (d) optimising the rate of injection of the viscosity reducing fluid to the one well or more than one well by adjusting the rate of injection of the viscosity reducing fluid to the or each well in the direction towards optimal production performance using the gradient of the production performance calculated in step (c), said optimisation being achieved either (i) in the case of a single well, by adjusting the rate of injection of the viscosity reducing fluid to the well until the production performance of the well reaches its optimal value, which can be maximal or minimal value, or (ii) in the case of more than one well, by adjusting the rates of injection of the viscosity inducing fluid to each well until the production performance of the total system of all wells reaches its optimal value, which can be maximal or minimal.

In a third aspect of the present invention, there is provided a system for optimising the production of oil from one or more wells, comprising a system for optimising the rate of injection of a viscosity reducing fluid between one or more wells according to the first aspect of the present invention.

In a fourth aspect of the present invention, there is provided a method for optimising the production of oil from one or more well, comprising a method for optimising the distribution of the viscosity reducing fluid between one or more wells according to the second aspect of the present invention.

BRIEF DESCRIPTION OF THE DRAWINGS

The invention is diagrammatically illustrated, by way of example, in the accompanying drawings, in which.

DESCRIPTION OF THE INVENTION

Figure 1:
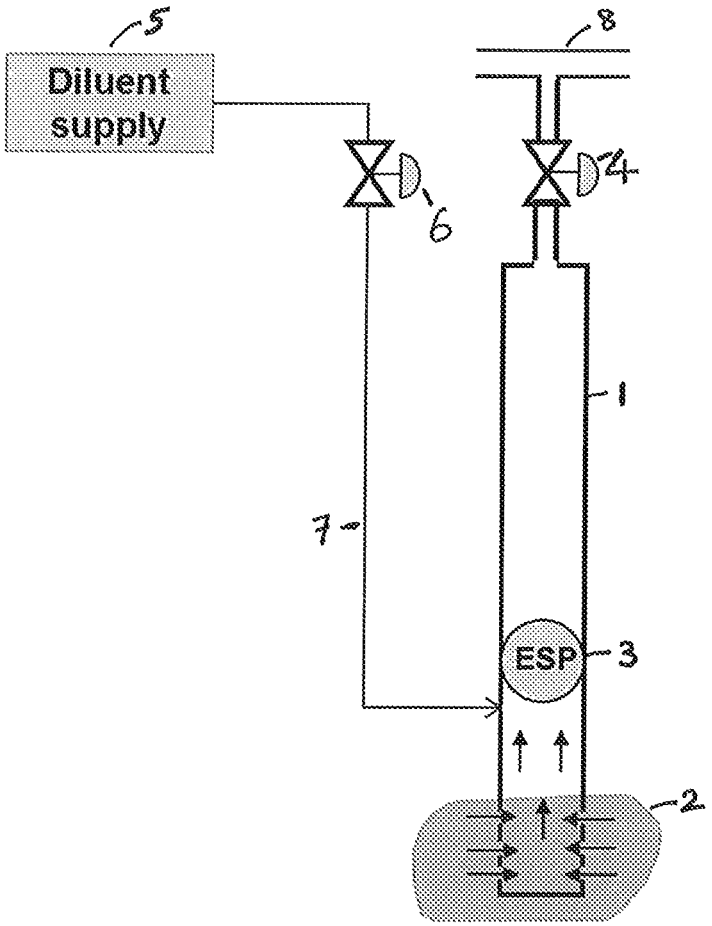
FIG. 1 is a schematic representation of a well comprising a downhole pump (an Electric Submersible Pump), and a diluent injection line.

The systems and methods of the present invention have many advantages over the systems and methods known previously. The system of the present invention is superior as it does not require the use of theoretical models or laboratory models. Instead, real time testing of the production performance through controlled variations of the injection rate of the viscosity reducing fluid into one, some or all of the wells enables the wells to be used as a "calculator" to find the gradient of production performance as a function of injection rate of the viscosity reducing fluid; and to adjust, following that gradient, the injection rate of the viscosity reducing fluid towards the value that brings optimal production performance for one or multiple wells.

One particular embodiment of this invention corresponds to the case when the optimisation system and/or the optimisation method described above are applied to a well with automatic control of pump speed to keep the pump intake pressure or pressure at a location in the well upstream from the injection point of the viscosity reducing fluid at a desired set-point. When the automatic controller keeps the pressure at a set-point, the reservoir fluid from the well is produced at a constant rate regardless of variations of the viscosity reducing fluid rate. By minimizing the pump power consumption, which is chosen as a production performance parameter, one optimises production at that constant production rate of the reservoir fluid. In this case all effects that the viscosity reducing fluid injection has on production are reflected as a single measured parameter: the power consumed by the pump. Since pump power is closely related to the pump speed and the pump motor current, one can also use them as production performance parameters instead of the pump power consumption. This particular application of the optimisation method described above is highly advantageous since it requires only the measurements of:

- the pressure at the pump intake or at a selected location in the well (for automatic pressure control);
- the injection rate of the viscosity reducing fluid; and
- production performance parameter (e.g. the pump power consumption, pump speed or pump motor current)

Sensors for all these measurements are available in very basic configurations of wells and no additional sensors are needed.

The method of the present invention addresses many of the problems associated with the prior art methods used for optimising the rate of injection of a viscosity reducing fluid into one or more wells:

- By using the steps of the present method, the method of the present invention enables the operator to dispense with the use of models with their associated uncertainties and inaccuracies, thus leading to more accurate optimisation results for the viscosity reducing fluid;
- The method of the present invention requires only measurements of the injection rate of the viscosity reducing fluid and measurements of the production performance or measurements that are used for production performance calculation. Measurements of fluid viscosity, flow rate, water cut, gas oil ratio, etc, that are needed to properly set up optimisation models for the existing technology are not needed;
- The method of the present invention allows the operator to find the optimal viscosity reducing fluid rate corresponding to the current well conditions in a given well, as compared to conditions used in simulations for a generic well or at well conditions from the past, and as a result these real time conditions are explicitly taken into account, which leads to a more optimal solution; and
- Implementation of steps (c) and (d) in an automatic way allows the system to maintain injection of the viscosity reducing fluid at an optimal value, even though that optimal value can change throughout production due to changing operating conditions in the well (e.g. changing water cut). Maintaining optimal injection rate occurs automatically without the need for an operator to monitor and adjust diluent rate at varying operating conditions.

In the present invention, the rate of injection of the viscosity reducing fluid into a given well (also referred to as the viscosity reducing fluid rate or rate of flow of the viscosity reducing fluid rate) is the rate of flow of the viscosity reducing fluid into a specific well via a specific injection line associated therewith. Thus, each well in a multiple well system may have a different rate of injection of a viscosity reducing fluid. Distribution of the available total flow rate of the viscosity reducing fluid between all wells should depend on the efficiency of the viscosity reducing fluid for each individual well. That efficiency is characterized by the gradient of the production performance as a function of the injection rate of the viscosity reducing fluid. The gradient is found through controlled variations of the injection rate of the viscosity reducing fluid, real-time measurements of the production performance corresponding to these variations, and processing these measurements.

The wells of the present invention may be vertical or deviated wells. The wells have a reservoir of oil containing fluid at the bottom thereof. In one embodiment, the wells are heavy oil wells. Heavy oil has high viscosity and specific gravity, as well as heavier molecular composition. Examples include heavy oils with viscosity higher than 50 cP.

In the present invention, the water cut is the ratio of water to the total volume of liquids produced from the reservoir.

In the present invention, the holding means for a viscosity reducing fluid may be any means for acting as a reservoir for the viscosity reducing fluid (e.g. a tank). It may be located at or near to the one or more wells or it may be situated at a location distant from the one or more wells and pumped to said wells when required.

In the present invention, the gradient of the production performance as a function of viscosity reducing fluid rate is the ratio of the small variation of the production performance and the variation of the viscosity reducing fluid rate. It is a very useful measure in practice as the gradient of the production performance shows the direction in which the injection rate must be changed to optimise (minimize or maximize) the production performance and how big will be the improvement of the production performance for a given change in injection rate of the viscosity reducing fluid. If the production performance gradient is greater than 0 at the current injection rate of the viscosity reducing fluid, then increasing the injection rate will increase the production performance. If the gradient is less than 0, then production performance can be increased by reducing the injection rate of the viscosity reducing fluid.

In the present invention, a downhole pump is a pump that is situated inside a well to provide artificial lift to the fluid present in the reservoir of the well. Typically, the downhole pump may typically be an electrical submersible pump (ESP), a hydraulically driven pump or a jet pump, and preferably an electrical submersible pump.

In the present invention, the viscosity reducing fluid is a fluid which is able to reduce the viscosity of the fluid produced from the reservoir when it is pumped into the wells by viscosity reducing fluid injection means. This reduction in viscosity can reduce power consumption by the downhole pump and/or increase production rate—in other words, it can optimise production performance. Examples of suitable viscosity reducing fluids include a diluent, water and an emulsion breaker, and a diluent is preferred, e.g. light oil.

In a preferred embodiment of the system of the present invention, it further comprises one or more of the following:

- (c) means for controlling the rate of injection of the viscosity reducing fluid;
- (d) optionally, means for substituting one viscosity reducing fluid with another viscosity reducing fluid;
- (e) optionally, means for automatic control of any of the pump, the well head choke or the means for controlling the rate of injection of the viscosity reducing fluid in the one or more wells for automatic control of one or more production performance parameters of one, some or all of the one or more than one well, operation of the pump or injection of the viscosity reducing fluid in the one, some or all of the one or more wells;
- (f) a computer control unit or an automatic control unit for processing the real-time measurements obtained by measurement means (a) and performing in an automatic or automated manner the variations and adjustments of the viscosity reducing fluid injection to optimise the production performance in means (b).

Components (c) to (f) of the present invention allow the optimisation process to be performed using a series of automated units. This makes it easy to perform thus enabling regular optimisation on a real time basis based on real time measurement.

In another preferred embodiment of the system according to the present invention, the total flow rate of viscosity reducing fluid available for injection into all wells of a multiple well system is limited and the means for optimising the rate of injection of the viscosity reducing fluid in the or each well comprises a computer unit for the computation in real time of the optimal distribution of the total flow rate of viscosity reducing fluid between the one or more wells so as to optimise the production performance of the production system consisting of said multiple well system.

The means for controlling the rate of injection of the viscosity reducing fluid can be an adjustable valve or a speed-adjustable pump.

The means for performing the real time measurements of said one or more production performance parameters and the rate of injection of the viscosity reducing fluid are typically sensors placed in the or each well, downhole pump, power supply unit or power supply line or the downhole pump and the or each injection line for the viscosity reducing fluid. The sensors may be provided with appropriate filters to reduce noise signals.

In one preferred embodiment of the system of the present invention, the computer unit (f) either displays the optimised rate of injection of viscosity reducing fluid to the or each well to an operator, thus enabling manual adjustment of the viscosity reducing fluid injection means to achieve the optimal rate of injection of viscosity reducing fluid injection means by said operator to to achieve the optimal rate of injection of viscosity reducing fluid to the or each well, or it is sent directly to the or each means for controlling the rate of injection of the viscosity reducing fluid and thus automatically adjusts the injection of the viscosity reducing fluid in the or each well to achieve the optimised production performance of the or each well or of the total production performance of the whole production system consisting of multiple wells. Preferably, the computer control unit (f) sends the computed optimised rate of injection of the viscosity reducing fluid for the or each well to the or each means for controlling the rate of injection of the viscosity reducing fluid, wherein said means is an adjustable valve or a pump with an adjustable pumping speed which are automatically adjustable by the computer unit (f).

In one preferred embodiment of the method of the present invention, in the case where there are multiple wells, step (c) can be performed on pairs of wells in which the variation of the rate of injection of the viscosity reducing fluid in one well is opposite to the direction in the other. As a consequence there is no change in the total viscosity reducing fluid injection rate for each well pair, which is advantageous for the top-side process.

In another preferred embodiment of the method according to the present invention, step (a) is performed when it is expected that stopping injection of the viscosity reducing fluid will lead to more optimal production performance of the or each well.

In yet another preferred embodiment of the method according to the present invention, step (a) is performed because it is expected that production from the well has reached water cut corresponding to the inversion point of the fluid without addition of the viscosity reducing fluid.

In the method of the present invention, the production performance is preferably optimised by the optimisation of the rate of injection of the viscosity reducing fluid into the one or more than one well.

The viscosity reducing fluid for use in the system and method of the present invention can be, for example, a diluent, water or an emulsion breaker. Preferably, the viscosity reducing fluid is a diluent, and most preferably a light oil.

The downhole pump for use in the system and method of the present invention is preferably an electrical submersible pump, a jet pump or a hydraulically driven pump and more preferably an electrical submersible pump. The well in the method of the present invention is preferably a heavy oil well.

In another preferred embodiment of the method according to the present invention, each of steps (a), optional step (b), (c) and (d) may independently be conducted manually or automatically.

In yet another preferred embodiment of the method according to the present invention, each of steps (a), optional step (b) (c) and (d) is conducted automatically.

In another preferred embodiment of the method according to the present invention, each of steps (c) and (d) is conducted simultaneously. When steps (c) and (d) are conducted simultaneously, the variation of the viscosity reducing fluid injection rate in step (c) may be a periodic variation around an average value; and the average value may be adjusted towards optimum in step (d). In step (c), the gradient may be estimated by a dynamical system. Furthermore, the adjustment of the average value may be done by a dynamical system.

In yet another preferred embodiment of the method according to the present invention, the automatic steps are performed by means of an automatic program run on a computer, wherein sensors in the viscosity reducing fluid lines and the sensors for measuring or estimation of the production performance automatically feedback the measurements from steps (a), optional step (b), (c) and (d) to the computer and on the basis of the measurements the program determines how to optimise the rate of injection of the viscosity reducing fluid into one, some or all of the one or more wells and automatically instructs appropriate action to be taken to achieve this.

The system for optimising the production of oil from one or more wells according to the third aspect of the present invention comprises a system for optimising the rate of injection of a viscosity reducing fluid between one or more wells according to the first aspect of the present invention and can incorporate all of the preferred embodiments of the system according to the invention.

The method for optimising the production of oil from one or more wells according to the fourth aspect of the present invention comprising a method for optimising the distribution of the viscosity reducing fluid between one or more wells according to the second aspect of the present invention and can incorporate all of the preferred embodiments of the method according to the invention.

As explained above, variations of the viscosity reducing fluid rate in step (c) can be conducted for multiple wells in pairs of wells in opposite direction, i.e. when variation of viscosity reducing fluid (e.g. diluent) injection rate for one well is opposite to the variation of the viscosity reducing fluid (e.g. diluent) injection rate in another well. In this case there will be no variation in the total viscosity reducing fluid injection rate which is advantageous for the top-side process. Moreover, in case when the pump and/or the well head choke are equipped with automatic controllers that maintain constant intake pressure at the pump intake, there will also be no variations in the total flow rate of the produced flow rate of the produced reservoir fluid, making this approach even more advantageous for the top-side process. This is a very favourable property. More advanced combinations of step (c) with the same idea as the one stated above can be used.

For multiple wells, the vector comprised of the production performance gradients in all wells is, in fact, the gradient of the total production performance for all wells as a function of viscosity reducing fluid injection rates. Once this gradient is known, one can use various existing gradient-based optimisation methods for optimising the total production performance of multiple wells as a function of viscosity reducing fluid injection rates. The simplest optimisation methods that can be used are linear programming methods, which are very cheap for implementation in terms of computational power. This sets very low requirements on the computer hardware needed for this system.

The principle of the present invention can be applied in an almost exactly the same way to transport lines equipped with booster pumps. To reduce viscosity of the fluid in the transport lines and in the booster pumps water, for example, may be injected upstream of the pumps. It is possible for the operator to use the same system and method as described above to such a transportation system. In this case, instead of application to a vertical well with a downhole pump, it will be an application to a horizontal line with a booster pump. The fluid (water in this case) is injected upstream the pump in both cases.

Further advantages and improvements associated with the method and system of the present invention include:

- The method of the present invention is based on direct measurements from the well where and when optimisation is applied and not from some generic simulated well or a well at some past conditions.
- The method of the present invention inherently takes into account all conditions, effects and hardware components from the well: reservoir inflow, inflow pipes, pump performance for 3-phase flow, quality of viscosity reducing fluid mixing with the oil phase, formation of emulsions, effects of pump speed/mixing on emulsion formation and flow regime, power losses in pump motor and cables. Many of these effects are not or cannot be modeled accurately at all, or they require parameters to set up corresponding models that cannot exactly be measured or found.
- The method of the present invention requires only standard instrumentation for the measurement of the rate of injection of the viscosity reducing fluid, and production performance parameter or parameters that can be used for evaluation of production performance. These parameters are also usually available for measurements.
- The method and system of the present invention utilise standard controllers that are available from pump vendors or vendors of Process Control Systems, which control the overall production. Automatic calculation of the production performance gradient, and the gradient-based optimisation, can be done using simple components like PID controllers, low-pass filters and integrators.
- The method of the present invention can be implemented either manually by an operator following the proposed algorithm, or by an automatic system, or by a combination of these two ways. In the beginning it can be implemented as a manual operation. After the methods gets trust and acceptance from the operators, it can be implemented as a fully automatic or partly automated routine.
- The optimisation routine requires little computational power, as it can be based on linear programming methods, which are well-known, straightforward to implement, and are very cheap computationally. Therefore it can be implemented directly in the Process Control System or in an inexpensive computer unit.
- The optimisation routine can easily be enhanced to more advanced, yet standard, gradient-like optimisation methods, which are available in the literature and well known to the skilled person in the field of downhole well production.
- The method of the present invention causes only minor disturbances to the top-side processing equipment. These minor disturbances can be significantly reduced or eliminated in multiple wells by combining production testing and power optimisation in pairs of wells in opposing directions.
- The method and system of the present invention can be combined with automatic control systems for downhole pumps and well head chokes. The only requirement is that these control systems have the functionality of set-point control of the pump intake pressure.
- Knowing when to stop viscosity reducing fluid injection in step (a) can save up to 50-60% of pump energy consumption in the period when the well is producing close to the inversion point.
- The method of the present invention allows one to take into account constraints on the rate of injection of viscosity reducing fluid (e.g. diluent) for each individual well and constraints on the total rate of injection of viscosity reducing fluid for all wells.

The present invention may be understood further by consideration of the following examples of the system and method of the present invention.

A schematic for a typical downhole well with a downhole pump is illustrated in FIG. 1. Each downhole well 1 has a reservoir 2 of oil at the bottom thereof. To provide artificial lift for the viscous oil to enable extraction thereon, the well is provided with a downhole pump in the form of an Electrical Submersible Pump (ESP) 3. Production rates can be adjusted by means of the production choke 4. In order to reduce the viscosity of the oil to help to increase the efficiency of the ESP, a diluent such as a light oil is injected from a diluent supply unit 5 via a diluent injection line 7 to the well, with the injection rate being controlled by a diluent choke 6. The reduced viscosity mixture thus obtained is pumped by the ESP 3 via the production choke 4 to the production manifold 8 to be pumped to the production facility.

Figure 2:
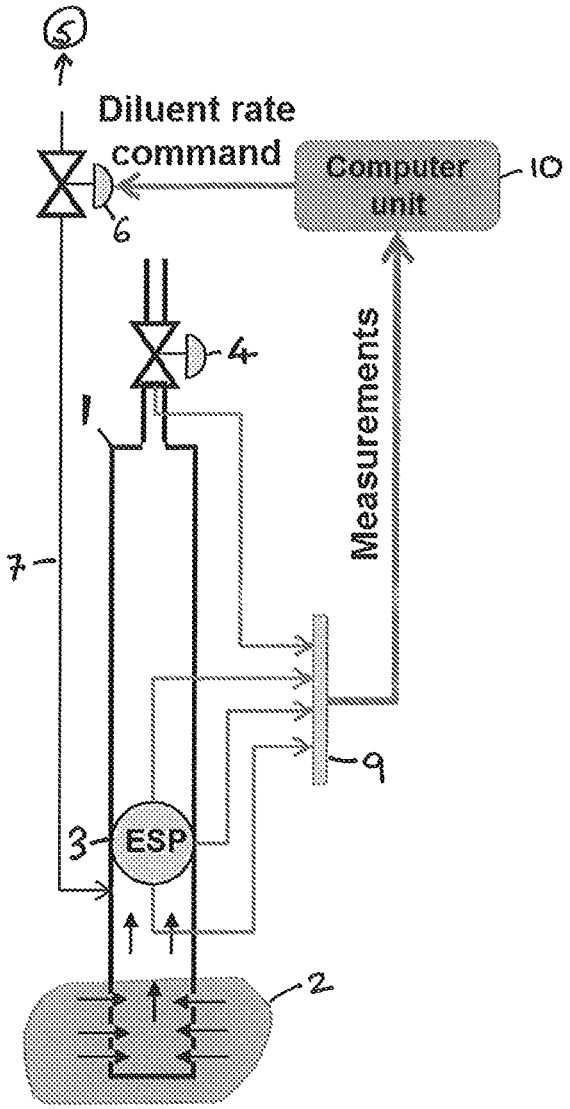
FIG. 2 is a schematic representation of a well as in FIG. 1, wherein the diluent injection choke is controlled by a computer unit, which eventually brings the diluent injection rate to an optimal value.

A schematic for a system for optimising the rate of injection of a viscosity reducing fluid to a downhole well 1 with a reservoir 2 of oil 2 is illustrated in FIG. 2. Each downhole well 1 has a reservoir 2 of oil at the bottom thereof. To provide artificial lift for the viscous oil to enable extraction thereon, the well is provided with a downhole pump in the form of an Electrical Submersible Pump (ESP) 3. Production rates can be varied by means of the production choke 4. In order to reduce the viscosity of the oil to help to increase the efficiency of the ESP, a viscosity reducing fluid such as a light oil is injected from a diluent supply unit 5 via a diluent injection line 7 to the well. The injection rate is controlled by means of a viscosity reducing fluid choke 6. The reduced viscosity mixture thus obtained is pumped by the ESP 3 via the production choke 4 to the production manifold to be pumped to the production facility. A series of sensors are present in the ESP, the production choke and the injection line and these feed measurements of the corresponding production performance parameters such as pressure at the ESP 3 intake, pressure at the ESP 3 discharge, power consumed by the ESP 3, current supplied to the ESP 3, and rate of injection of the viscosity reducing fluid, via main sensor 9 to a central computer control unit 10.

In practice in the present invention, the operator makes a small variation in the rate of injection of the viscosity reducing fluid via the injection line 7. This results in a corresponding variation in one of the production performance parameters, for example the intake pressure at the ESP 3. The aim is to allow either the operator or a computer control unit as in the case of the system of FIG. 2 to use this iterative process in real time to decide after each step whether to increase or decrease the viscosity reducing fluid injection rate depending upon the effect achieved on the system by the previous change, with the steps repeated until the viscosity reducing fluid injection rate is optimised. At this same point, the intake pressure will also be optimised, as will the production performance of the well system as a whole.

Figure 3:
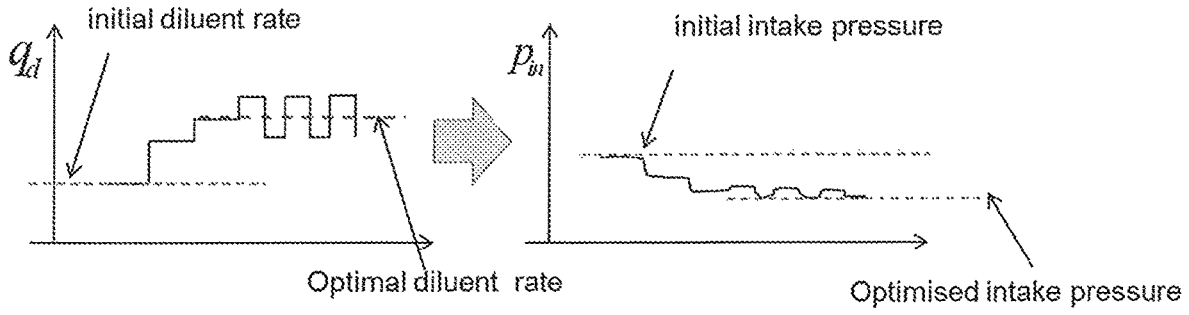
FIG. 3 is a schematic representation illustrating an optimisation process for pump intake pressure according to the present invention.

Plots of variation of viscosity reducing fluid rate $q_d$ (e.g. a diluent) against time and corresponding variation of intake pressure against time are shown in FIG. 3. With each variation of the viscosity reducing fluid rate $q_d$ the sensors 10 detect the variation in intake pressure $p_{in}$ that is produced and feed this figure to the computer control unit 10. The computer control unit 10 then automatically adjusts the rate of injection of the viscosity reducing fluid in the well (if necessary) by means of the viscosity reducing fluid choke 6. This is repeated until optimisation of the viscosity reducing fluid rate is achieved. By achieving optimisation of the viscosity reducing fluid rate the production performance of the well, as measured by the intake pressure is also optimised. This automatically controlled process based on feedback from the system in real time can be seen in the trace of the plots against time as they both move towards optimisation.

Figure 4:
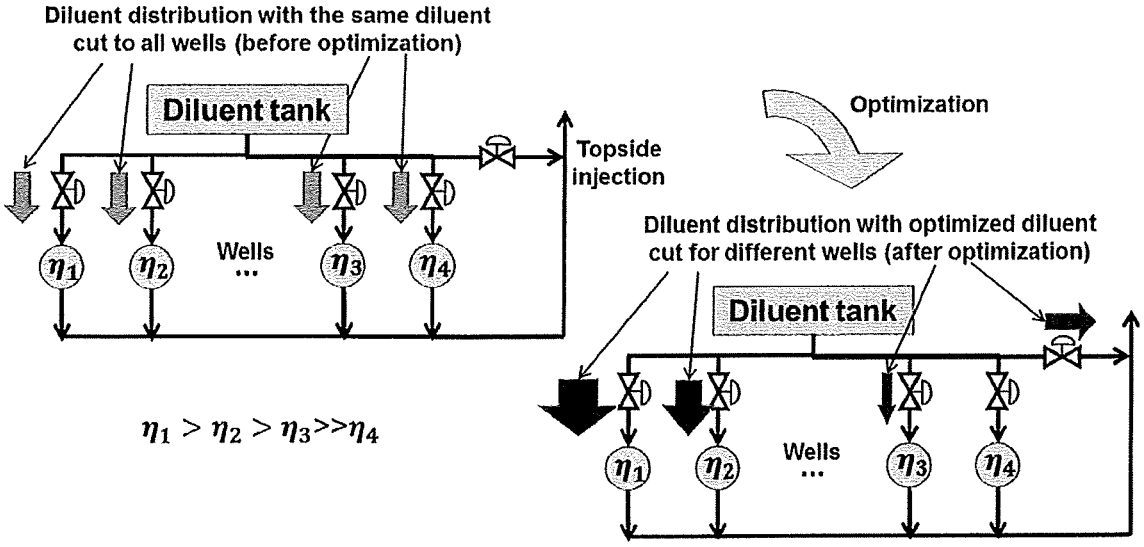
FIG. 4 is a schematic representation of a multiple well set up with a diluent distribution system prior to optimisation according to the present invention, and a schematic representation of the same multiple well set up and diluent distribution system after optimisation with an optimised diluent cut for each well determined by the diluent efficiency q for each well.

A schematic of a production system with four wells and diluent injection lines to each of these wells and to a topside location is illustrated in FIG. 4. Before optimisation, diluent is injected to all wells with the same diluent cut. After optimisation according to the present invention (see more below), as the diluent efficiency $\eta$ depends on the well conditions (e.g. on water cut), more diluent is injected to wells with higher diluent efficiency. In this example, $\eta_1>\eta_2>\eta_3>>\eta_4$—diluent efficiency in well 1 is higher than in well 2, which is higher than in well 3, which, in turn, is much higher than in well 4. For well 4 with very low diluent efficiency the diluent injection is stopped and rerouted to other wells and, if necessary, to a topside injection point.

In one test, a plot of ESP power versus diluent cut for a fixed oil rate from a reservoir was made based on tests in a multiphase flow-loop in that reservoir with an emulated well, full scale ESP and viscous oil. Diluent efficiency was clearly found to be different for different water cuts. As an illustration, for 0% water cut, injection of diluent at 5% diluent cut gave a 5 kW reduction of ESP power; for a 35% water cut, injecting diluent at the same rate (and diluent cut) gave a 22 kW reduction of ESP power; for a 60% water cut (water continuous flow) diluent injection at the same diluent cut gives only approximately a 1 kW reduction of ESP power. This clearly illustrates that diluent efficiency varies significantly with water cut.

The invention claimed is:

1. A system for optimizing the injection of a viscosity reducing fluid to a multiple well system including multiple wells, comprising a downhole pump positioned in each well, and a shared holding means for a viscosity reducing fluid, said shared holding means being connected to each well via one or more injection lines through which the viscosity reducing fluid may be pumped by viscosity reducing fluid injection means;

wherein said system comprises:

(a) measurement means for real time measurement of one or more production performance parameters of said wells, and measurement of the rate of injection of the viscosity reducing fluid into said wells; and (b) means for optimizing the injection of the viscosity reducing fluid to each well so as to optimize the production performance on the basis of:

(i) adjustment of the production process through means for making controlled variations of the viscosity reducing fluid injection into the wells;

(ii) means for the processing of the real time measurements of the production performance parameters affected by these variations to determine any necessary adjustment of the injection of the viscosity reducing fluid towards an optimal value; and (iii) if required, making the corresponding physical adjustment of the injection of the viscosity reducing fluid in order to bring production performance closer to the optimal point, wherein a total flow rate of viscosity reducing fluid available for injection into all wells of the multiple well system is limited and an adjustment to increase the injection rate of the viscosity reducing fluid into one of the wells of the multiple well system will decrease the injection rate of the viscosity reducing fluid into at least one of the other wells in the multiple well system, and the means for optimizing the rate of injection of the viscosity reducing fluid in each well comprises a computer unit for the computation in real time of an optimal distribution of the total flow rate of viscosity reducing fluid between the wells so as to optimize the production performance of the production system including said multiple well system.

2. The system according to claim 1, further comprising one or more of the following:

(c) means for controlling the rate of injection of the viscosity reducing fluid;

(d) means for substituting one viscosity reducing fluid with another viscosity reducing fluid;

(e) means for automatic control of any of the pump, a well head choke or the means for controlling the rate of injection of the viscosity reducing fluid in the wells for automatic control of one or more production performance parameters of one, some or all of the wells, operation of the pump or injection of the viscosity reducing fluid in the one, some or all of the wells.

3. The system according to claim 2, wherein the means for controlling the rate of injection of the viscosity reducing fluid is selected from an adjustable valve and a speed-adjustable pump.

4. The system according to claim 1, wherein the production performance parameters of a well can be one or more of the following: the liquid flow rate produced by the well, the oil flow rate produced by the well, the gas flow rate produced by the well, the pressure at the pump intake, the pressure at the pump discharge, the pressure at the well head, the pressure at a location in the well, the temperature at the pump intake, the temperature at the pump discharge, the temperature at the well head, the temperature at a location in the well; the power consumed by the pump, the current supplied to the pump electrical motor, the ratio of power consumed by the pump and the liquid flow rate produced by the well, the ratio of power consumed by the pump and the oil flow rate produced by the pump, the ratio of current supplied to electrical motor of the pump and the liquid flow rate produced by the well, the ratio of current supplied to electrical motor of the pump and the oil flow rate produced by the well, the ratio of oil flow rate produced by the well and the rate of the viscosity reducing fluid injected in the well, the efficiency of the pump, and the efficiency of the overall production system.

5. The system according to claim 1, wherein the production performance of a production system including multiple wells can be optimized by optimization of any one or more of the following production performance parameters: the total power consumed by all pumps from all wells, the total liquid flow rate produced from all wells, the total oil flow rate produced from all wells, the total gas flow rate produced from all wells, the ratio of the total power consumed by all pumps and the total liquid flow rate produced from all wells, the ratio of the total power consumed by all pumps and the total oil flow rate produced from all wells, and the ratio of the total oil rate produced by all wells and the total rate of viscosity reducing fluid injected in all the wells.

6. The system according to claim 1, wherein the downhole pump is an electrical submersible pump, a hydraulic driven submersible pump or a jet pump.

7. The system according to claim 1, wherein the viscosity reducing fluid is selected from a diluent, water and an emulsion breaker.

8. The system according to claim 1, wherein the means for real time measurements of said one or more production performance parameters and the rate of injection of the viscosity reducing fluid recited in step (a) are sensors placed in the or each well, downhole pump, power supply unit or power supply line for the downhole pump and in the or each injection line for the viscosity reducing fluid.

9. The system according to claim 1, wherein the computer unit either displays the optimized rate of injection of viscosity reducing fluid to each well to an operator, thus enabling manual adjustment of the viscosity reducing fluid injection means by the said operator to achieve the optimal rate of injection of the viscosity reducing fluid to each well, or it is sent directly to the or each means for controlling the rate of injection of the viscosity reducing fluid and thus automatically adjusts the injection of the viscosity reducing fluid in each well to achieve the optimized production performance of each well or of the total production performance of the whole production system including multiple wells.

10. The system according to claim 9, wherein the computer unit sends the computed optimized rate of injection of the viscosity reducing fluid for the or each well to each means for controlling the rate of injection of the viscosity reducing fluid, wherein said means is an adjustable valve or a pump with an adjustable pumping speed which are automatically adjustable by the computer unit.

11. The system according to claim 1, wherein the downhole pump is automatically controlled to maintain constant pressure at the pump intake, while the production performance parameter of the well that is measured is the power consumed by the pump.

12. A method for optimizing the injection of a viscosity reducing fluid from a shared holding means into a multiple well system including multiple wells, wherein each well comprises a downhole pump, and the viscosity reducing fluid is pumped via one or more injection lines by viscosity reducing fluid injection means to each well, the method comprising the following steps:

(a) optionally, stopping the injection of the viscosity reducing fluid into one or more wells and determining the change in the production performance of the well or more than one well, and then (i) maintaining the stoppage of the injection of the viscosity reducing fluid to each well where the production performance improves or remains the same, or (ii) resuming injection of the viscosity reducing fluid at the previous injection rate to each well where the production performance deteriorates;

(b) optionally, replacing a first viscosity reducing fluid with a second viscosity reducing fluid or water and then determining whether the production performance improves, in which case the second viscosity reducing fluid or water is retained, or whether it deteriorates in which case the second viscosity reducing fluid or water is replaced by the first viscosity reducing fluid;

(c) varying the rate of injection of the viscosity reducing fluid to the wells, measuring or calculating from measurements the variation in the production performance in the wells corresponding to the variation of the rate of injection of the viscosity reducing fluid and calculating the gradient of the production performance for the wells as a function of the rate of injection of viscosity reducing fluid for the wells; and (d) optimizing the rate of injection of the viscosity reducing fluid to the wells by adjusting the rate of injection of the viscosity reducing fluid to the wells in the direction towards optimal production performance using the gradient of the production performance measured or calculated in step (c), said optimization being achieved by adjusting the rates of injection of the viscosity inducing fluid to each well until the production performance of the total system of all wells reaches its optimal value, which can be maximal or minimal, wherein the step (c) is performed on pairs of wells in which the variation of the rate of injection of the viscosity reducing fluid in one well is opposite to the direction in the other, and an adjustment to increase the injection rate of the viscosity reducing fluid into one of the wells of the multiple well system decreases the injection rate of at least one of the other wells in the multiple well system.

13. The method according to claim 12, wherein step (a) is performed when it is expected that stopping injection of the viscosity reducing fluid will lead to more optimal production performance of the or each well or step (a) is performed because production from the well has reached water cut corresponding to the inversion point of the fluid without addition of the viscosity reducing fluid.

14. The method according to claim 12, wherein the production performance is optimized by the optimization of the rate of injection of the viscosity reducing fluid into the one or more than one well.

15. The method according to claim 12, wherein the viscosity reducing fluid is selected from a diluent, water and an emulsion breaker.

16. The method according to claim 12, wherein the downhole pump is an electrical submersible pump, a hydraulically driven submersible pump or a jet pump.

17. The method according to claim 12, wherein the downhole pump and/or a production choke therefor are controlled by automatic control systems to maintain constant pressure at the pump intake, while the production performance parameter to be optimized is the power consumed by the pump.

18. The method according to claim 12, wherein each of steps (a), optional step (b), (c) and (d) may independently be conducted manually or automatically.

19. The method according to claim 18, wherein the automatic steps are performed by means of an automatic program run on a computer, wherein sensors in the viscosity reducing fluid lines and the sensors for measuring or estimation of the production performance automatically feedback the measurements from steps (a), optional step (b), (c) and (d) to the computer and on the basis of the measurements the program determines how to optimizing the rate of injection of the viscosity reducing fluid into the wells and automatically instructs appropriate action to be taken to achieve this.

20. The method according to claim 12, wherein each of steps (c) and (d) is conducted simultaneously.

21. The method according to claim 20, where the variation of the viscosity reducing fluid injection rate in step (c) is a periodic variation around an average value; and the average value is adjusted towards optimum in step (d).

22. The method according to claim 20, wherein in step (c) the gradient is estimated by a dynamical system.

23. The method according to claim 20, wherein the adjustment of the average value is done by a dynamical system.

24. A system for optimizing the injection of a viscosity reducing fluid to a multiple well system, comprising a downhole pump positioned in each well, and a shared holding means for a viscosity reducing fluid, said shared holding means being connected to each well via one or more injection lines through which the viscosity reducing fluid may be pumped by viscosity reducing fluid injection means; wherein said system comprises:

(a) measurement means for real time measurement of one or more production performance parameters of said wells, and measurement of the rate of injection of the viscosity reducing fluid into said wells; and (b) means for optimizing the injection of the viscosity reducing fluid to each well so as to optimize the production performance on the basis of:

(i) adjustment of the production process through means for making controlled variations of the viscosity reducing fluid injection into the wells;

(ii) means for the processing of the real time measurements of the production performance parameters affected by these variations to determine any necessary adjustment of the injection of the viscosity reducing fluid towards an optimal value; and (iii) if required, making the corresponding physical adjustment of the injection of the viscosity reducing fluid in order to bring production performance closer to the optimal point;

wherein the total flow rate of viscosity reducing fluid available for injection into all wells of the multiple well system is limited and adjustment of the injection rate of the viscosity reducing fluid into each of the wells of the multiple well system is determined based on the efficiency of the viscosity reducing fluid for each individual well, and the means for optimizing the rate of injection of the viscosity reducing fluid in each well comprises a computer unit for the computation in real time of the optimal distribution of the total flow rate of viscosity reducing fluid between the wells so as to optimize the production performance of the production system consisting of said multiple well system.

* * * * *